US011577539B1

(12) United States Patent
Chen et al.

(10) Patent No.: US 11,577,539 B1
(45) Date of Patent: Feb. 14, 2023

(54) POP-UP GREETING CARD WITH PLUSH DISPLAY ELEMENT

(71) Applicants: 100 Greetings, LLC, Clearwater, FL (US); Jast Company Limited, Shenzhen (CN)

(72) Inventors: Jen-Lin Chen, Cupertino, CA (US); Anthony Carl T. Gonzales, Parañaque (PH); Jay Kamhi, Belleair, FL (US)

(73) Assignees: 100 Greetings, LLC, Clearwater, FL (US); Jast Company Limited

( * ) Notice: Subject to any disclaimer, the term of this patent is extended or adjusted under 35 U.S.C. 154(b) by 0 days.

(21) Appl. No.: 17/412,042

(22) Filed: Aug. 25, 2021

(51) Int. Cl.
*G09F 1/06* (2006.01)
*B42D 15/02* (2006.01)
*B42D 15/04* (2006.01)

(52) U.S. Cl.
CPC ..... *B42D 15/022* (2013.01); *B42D 15/042* (2013.01); *G09F 1/06* (2013.01)

(58) Field of Classification Search
CPC ..... G09F 1/06; G09F 1/08; G09F 2001/085; B42D 15/022; B42D 15/042
See application file for complete search history.

(56) References Cited

U.S. PATENT DOCUMENTS 2,974,434 A * 3/1961 Dora ..... B42D 15/04 428/116
3,228,138 A * 1/1966 Lohnes ..... B42D 15/04 D19/7
3,995,388 A * 12/1976 Penick ..... G09F 1/06 446/148
4,349,973 A * 9/1982 Penick ..... G09F 1/06 446/148
6,199,308 B1 * 3/2001 Westendorp ..... B42D 15/042 40/539
7,292,681 B2 11/2007 Pines
7,845,099 B2 12/2010 Ross et al.
8,418,384 B2 4/2013 Jin et al.
8,595,961 B2 12/2013 Mayer et al.
8,752,313 B2 6/2014 Wilson et al.
10,155,173 B2 12/2018 Simmons et al.
2008/0016732 A1 * 1/2008 Gardi ..... B42D 1/003 40/124.08
2011/0258892 A1 10/2011 Taylor et al.
2013/0139418 A1 6/2013 Bogdanski et al.
2013/0255115 A1 * 10/2013 Hughes ..... G09F 1/04 40/124.02

(Continued)

*Primary Examiner* — Gary C Hoge
(74) *Attorney, Agent, or Firm* — LaMorte & Associates P.C.

(57) ABSTRACT

A greeting card assembly that contains a first flap and a second flap that are joined at a central fold seam. The first flap and the second flap can move between an open configuration and a closed configuration. A flat center support is provided that extends vertically over the central fold seam. The flat center support has a flat face surface and a flat back surface. A plush body is set in the center of the greeting card assembly. The plush body is attached to both the first flap and the second flap. The flat center support extends into an interior of said plush body through an open bottom. When the first flap and the second flap are moved into their closed configuration, the plush body is pressed against both the flat face surface and the flat back surface of the flat center support.

18 Claims, 5 Drawing Sheets

(56) References Cited

U.S. PATENT DOCUMENTS

| | | | | |
|---|---|---|---|---|
| 2013/0269225 | A1* | 10/2013 | Nelson | G06F 1/00 40/124.03 |
| 2017/0087481 | A1* | 3/2017 | Simmons | A63H 33/38 |
| 2018/0244097 | A1* | 8/2018 | Bassett | B65D 73/0078 |

* cited by examiner

POP-UP GREETING CARD WITH PLUSH DISPLAY ELEMENT

BACKGROUND OF THE INVENTION

1. Field of the Invention

In general, the present invention relates to greeting cards that contain folded pop-up elements that extend when the greeting card is opened. More particularly, the present invention relates to pop-up greeting cards that create three-dimensional displays when opened that are enhanced with internal electronics.

2. Prior Art Description

Greeting cards have been made and sold for centuries. In modern times, a greeting card is typically made from a folded piece of thick paper stock. This requires that the card be unfolded or "opened" in order to read the message printed on the card.

Since a greeting card must be manually unfolded to be read, it is possible for folded constructs to be incorporated into the structure of the greeting card. The folded constructs fold flat when the card is closed and pop-up when the card is opened. As a result, the folded construct goes from a folded position where it is parallel to the flaps of the card to an unfolded position where the constructs is positioned generally perpendicular to the flaps of the card. In the card industry, such cards are commonly referred to as pop-up cards.

In order to make a pop-up card, the construct that actually pops up must meet two criteria. First, the construct must fold flat so that the construct does not hold the card open when the card is closed. This enables the pop-up card to be placed in a flat envelope. Second, the construct must be rigid enough to unfold and stand erect when the card is open. These two criteria are both met by constructs cut from a flat paper sheet or a flat plastic sheet. Accordingly, most pop-up constructs used in cards are made from flat pieces of paper or plastic.

Pop-up constructs made of paper or plastic can be formed into visually interesting shapes. However, the pop-up constructs tend to be skeletons that lack plush texture. For example, paper and plastic can form the image of a teddy bear, but they cannot form a construct with the plush texture of a teddy bear. In order to form a pop-up construct with a plush texture, plush fabrics must be used. However, plush fabrics lack the aforementioned criteria needed to create a pop-up. That is, the plush materials lack the structural integrity needed to stand erect. As such, plush fabrics but be stuffed or otherwise internally supported, which prevents the greeting card from closing.

A need therefore exists for a way to create a plush pop-up display within the confines of a greeting card, wherein the plush display is capable of standing erect and does not interfere with the ability of the card to close. These needs are met by the present invention as described and claimed below.

SUMMARY OF THE INVENTION

The present invention is a greeting card assembly that contains a first flap and a second flap that are joined at a central fold seam. The first flap can be rotated over the second flap to a closed configuration or away from the second flap to an open configuration.

A flat center support is provided that extends vertically over the central fold seam. The center support has a flat face surface and a flat back surface. A plush body is set in the center of the greeting card assembly. The plush body includes an interior paper liner that is covered in a plush exterior surface. The plush body has a hollow interior accessible through an open bottom. The plush body is attached to the first flap at a first distance from the central fold seam. Likewise, the plush body is attached to the second flap at a second distance from the central fold seam.

The flat center support extends into the interior of the plush body through the open bottom. The plush body and the flat center support are not interconnected and move independently. When the first flap and the second flap are moved into their closed configuration, the plush body is pressed against both the flat face surface and the flat back surface of the flat center support. This create a flat folded greeting card assembly that can be fit into a standard envelope.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention greeting card assembly can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered limiting when interpreting the scope of the claims.

Figure 1:
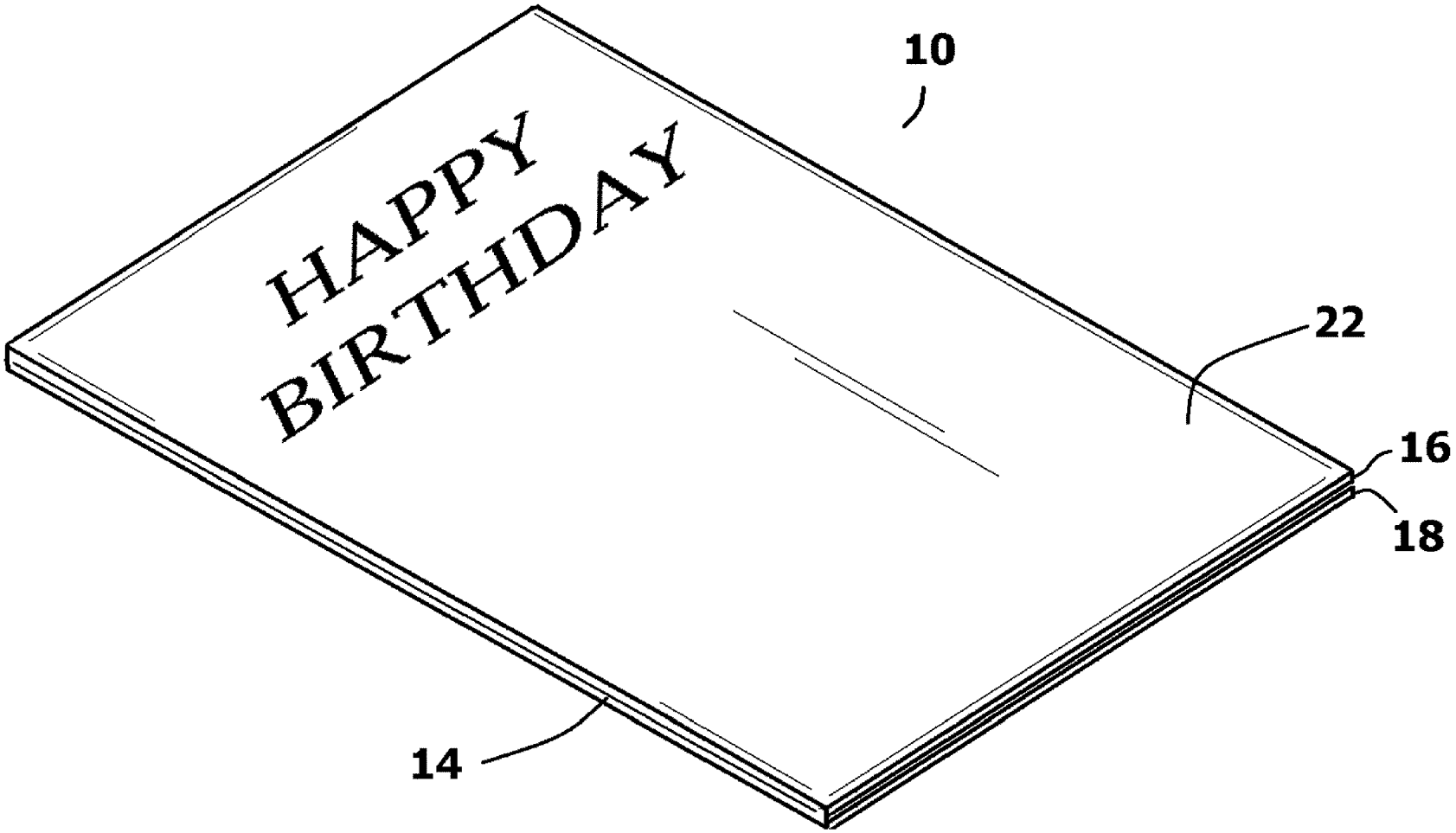
FIG. 1 shows an exemplary embodiment of a greeting card assembly in a closed configuration.
Figure 2:
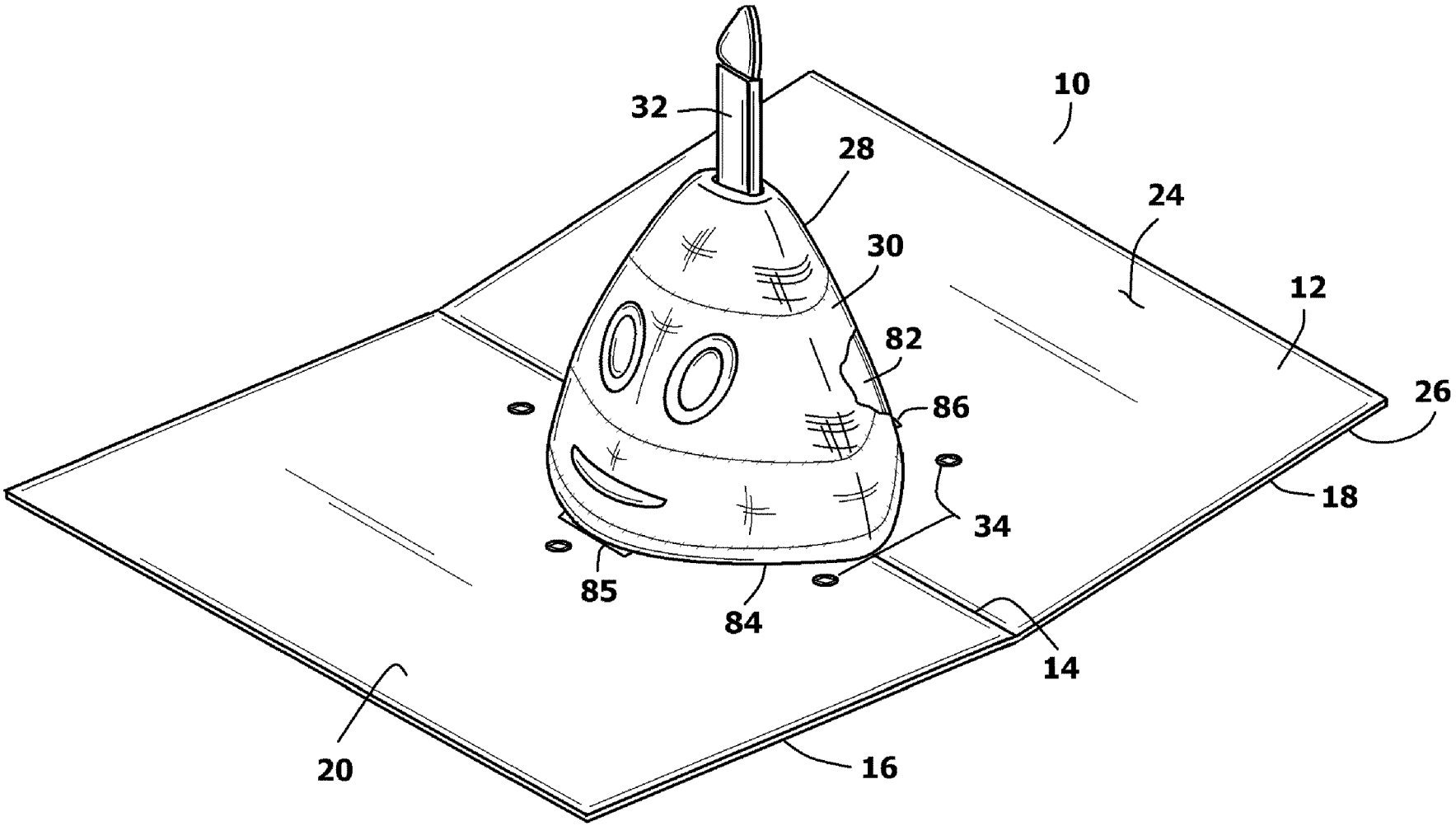
FIG. 2 shows the exemplary embodiment of FIG. 1 in an open configuration.

Referring to FIG. 1 in conjunction with FIG. 2, a greeting card assembly 10 is shown. The greeting card assembly 10 has a base substrate 12 with a central fold seam 14. This divides the base substrate 12 into two equal flaps 16, 18. The first flap 16 folds over the second flap 18, therein forming the principal shape of a greeting card. The first flap 16 has an interior surface 20 and an exterior surface 22. Likewise, the second flap 18 has an interior surface 24 and an exterior surface 26. When the first flap 16 folds over the second flap 18, the greeting card assembly 10 is considered closed and the interior surface 20 of the first flap 16 faces the interior surface 24 of the second flap 18. When the first flap 16 is rotated away from the second flap 18 to a configuration where the first flap 16 and the second flap 18 are coplanar, then the greeting card assembly 10 is considered open.

A pop-up construct 28 is disposed in the center of the greeting card assembly 10. The pop-up construct 28 attaches to the interior surface 20 of the first flap 16 and the interior surface 24 of the second flap 18. The pop-up construct 28 can fold flat when the greeting card assembly 10 is in its closed configuration. When in the closed configuration and compressed, the folded pop-up construct 28 separates the first flap 16 from the near-parallel second flap 18 by no more than ⅛th of an inch. This will enable the greeting card assembly 10 to fit within a standard paper envelope.

As is shown in FIG. 2, when the greeting card assembly 10 is in its open configuration, the pop-up construct 28 extends from the interior surfaces 20, 24 of the first flap 16 and the second flap 18. The pop-up construct 28 expands into a three dimensional shape and has an exterior that is mostly covered in a plush material. In the illustrated embodiment, the pop-up construct 10 (28) is shaped as an emoji. However, it will be understood that the pop-up construct 28 can have many shapes, such as that of a teddy bear or other plush object. As will be explained later in greater detail, the pop-up construct 28 has a plush body 30 and at least one appendage 32 that extend from the plush body 30. The pop-up construct 28 also contains lights 34 and an audio speaker that is later described. As such, the greeting card assembly 10 can flash lights and play music and sounds when the greeting card assembly 10 is manipulated into its open configuration.

Figure 3:
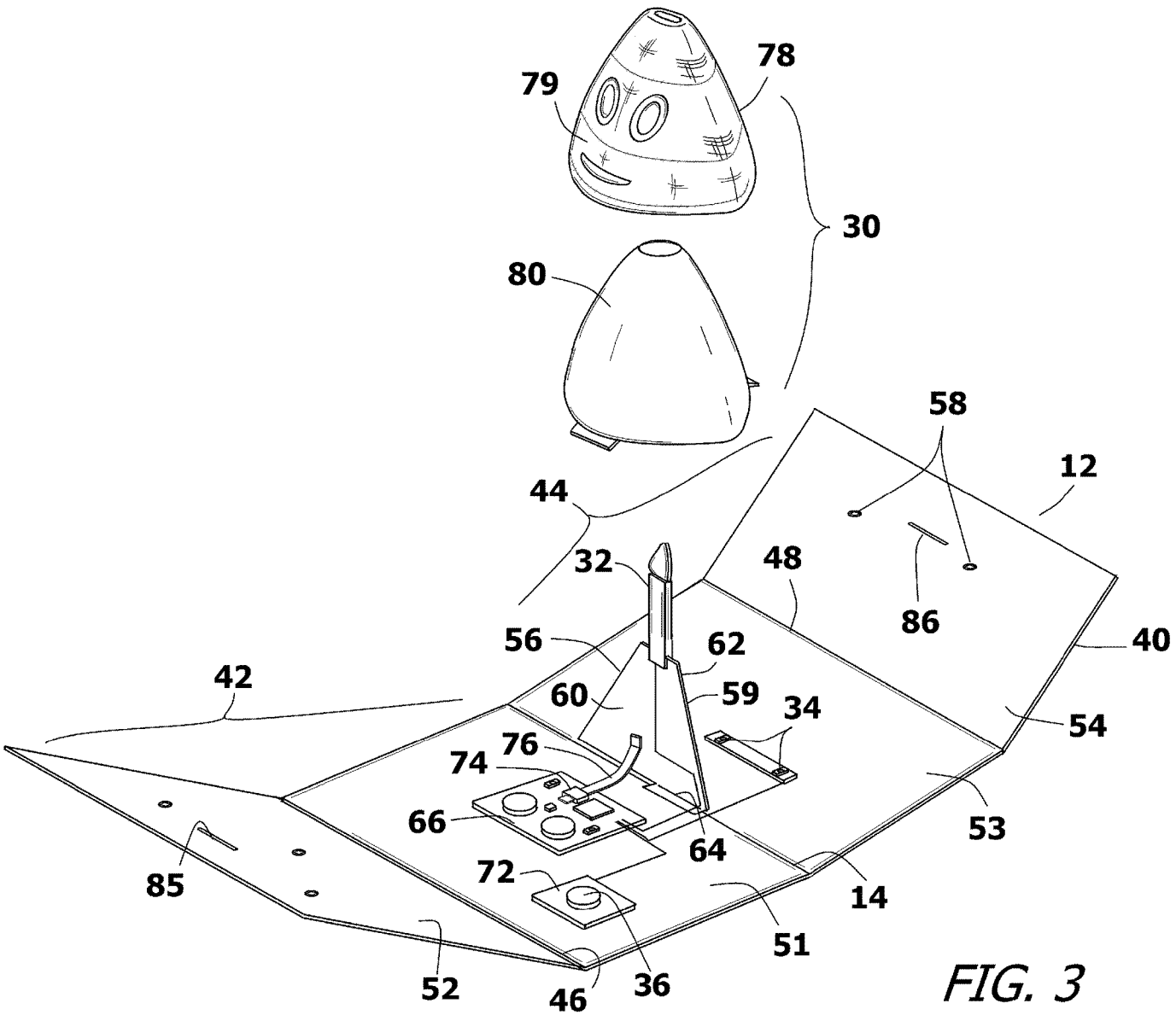
FIG. 3 shows an exploded view of the exemplary embodiment of FIG. 1 and FIG. 2.

Referring to FIG. 3 in conjunction with FIG. 2, it can be seen that the base substrate 12 has a laminated construction. A rectangular sheet 40 is provided. The rectangular sheet 40 can be a sheet of any paper, paperboard, cardboard, or plastic that can be readily folded. The central fold seam 14 is formed in the rectangular sheet 40. This divides the rectangular sheet 40 into a first section 42 and a mirrored second section 44. The first section 42 has a bisecting fold 46 that is parallel to the center fold seam 14. Likewise, the second section 44 has a bisecting fold 48 that is also parallel to the center fold seam 14. As a result, the center fold seam 114 and the bisecting folds 46, 48 segment the rectangular sheet 40 into four panels 51, 52, 53, 54. The first section 42 contains the first panel 51 and the second panel 52. The second section 44 contains the third panel 53 and the fourth panel 54. Holes 58 are formed in the first panel 51 and the fourth panel 54 for purposes that are later described.

The plush body 30 and the appendage 32 are supported by a flat center support 56. The flat center support 56 is made from a segment of paperboard, cardboard or plastic that is just thick enough to stand vertically and not be bent by its own weight. The flat center support 56 is essentially two dimensional with a side edge 59 that is only as thick as the sheet of material used. The flat center support 56 has a face surface 60 and back surface 62 that are both large and flat. Both the face surface 60 and the back surface 62 of the flat center support 56 have an outline that complements the profile of the plush body 30. In the shown embodiment, the plush body 30 has the shape of an emoji. Consequently, the profile of the flat center support 56 has the general shape of the emoji. The flat center support 56 is attached to both the first panel 51 and the third panel 53 so that the flat center support 56 extends in a vertical plane above the central fold seam 14. This is accomplished by creating a flexible connection 64 between the flat center support 56 and the base substrate 12. The flexible connection 64 can be formed by attaching the face surface 60 and/or the back surface 62 of the flat center support 56 to the first panel 51 and/or the third panel 53 with tape or flexible segments of paper and adhesive. The flexible connection 64 enables the flat center support 56 to flex and remain in the same plane as the central fold seam 14 while the first flap 16 is opened and closed relative to the second flap 18.

The appendage 32 is attached to the flat center support 56. The appendage 32 is also made from flat material and extends in the same plane as does the flat center support 56. In a selective construction, the appendage 32 can either be adhered to the flat center support 56 or the appendage 32 and the flat center support 56 can be unistructurally cut from the same sheet of material. The appendage 32 extends vertically from the flat center support 56 and terminates above the flat center support 56.

A circuit board 66 is provided. The circuit board 66 contains control circuitry 68 and batteries 70 arranged in a flat configuration. The circuit board 66 controls lights 34 and the audio speaker 36. The lights 34 can be selectively flashed. Likewise, music and/or sounds can be broadcast from the audio speaker 36. The lights 34 are present on the flaps 16, 18 and on the appendage 32. The circuit board 68, lights 34 and audio system 36 can be set on secondary supports 72. The lights 34 align with the holes 58 in the second panel 52 and/or the fourth panel 54 when the panels 52, 54 are folded over the first panel 51 and/or the third panel 53. The supports 72 can optionally be used under the circuit board 66, lights 34 and/or audio speaker 36 to prevent these elements from deforming the material of the rectangular sheet 40.

The circuit board 66 contains an on/off switch 74. The on/off switch 74 is activated and deactivated by a flexible tab 76 that attaches to the flat center support 56. As the first flap 16 is moved between its open configuration and its closed configuration, the circuit board 66 moves with the first flap 16. This moves the on/off switch 74 relative to the flexible tab 76. As such, the circuit board 66 can be made to activate when the greeting card assembly 10 is open and deactivate when the greeting card assembly 10 is closed.

The first panel 51 of the rectangular sheet 40 is folded over the second panel 52 and is sealed closed. This interposes the circuit board 66, audio speaker 36 and some lights 34 between the first panel 51 and the second panel 52, therein completing the first flap 16. Likewise, the fourth panel 54 of the rectangular sheet 40 is folded over the third panel 53 and is sealed closed. This interposes some of the lights 34 between the fourth panel 54 and the third panel 53, therein completing the second flap 18.

The plush body 30 is a construct that includes a plush shell 78 with a paper liner 80. The plush shell 78 has an exterior 79 that is in the image of a desired object. In the illustrated case, the object is an emoji. The plush shell 78 is sewn from one or more segments of plush fabric material. Being fabric, the plush shell 78 lacks the structural integrity to stand erect under the forces of its own weight. To add structural integrity, the plush shell 78 is sewn or adhesively adhered to an internal paper liner 80. The paper liner 80 is preferably paper and is just thick enough to support the weight of the plush shell 78. Both the plush shell 78 and the paper liner 80 define the walls of the plush body 30, wherein the plush body 30 defines an open interior 82 that is accessible through a wide open base 84.

The paper liner 80 is attached to the interior of the plush shell 78. The paper liner 80 is also attached to both the first flap 16 and the second flap 18 at opposing attachment points 85, 86. The opposing attachment points 85, 86 are symmetrically disposed on opposite sides of the central fold seam 14. Consequently, both attachment points 85, 86 are at a distance from the central fold seam 14. When viewed vertically from above, both the plush body 30 containing the shell 78 and its paper liner 80 are bisected by the central fold seam 14. The plush body 30 is placed over the flat center support 56 and any appendage 32 that extends from the flat center support 56. The flat center support 56 extends vertically above the central fold seam 14. The flat center support 56 is not physically attached to the plush body 30. However, the flat center support 56 supports the plush body 30 in a central position that is above the central fold seam 14.

Figure 4:
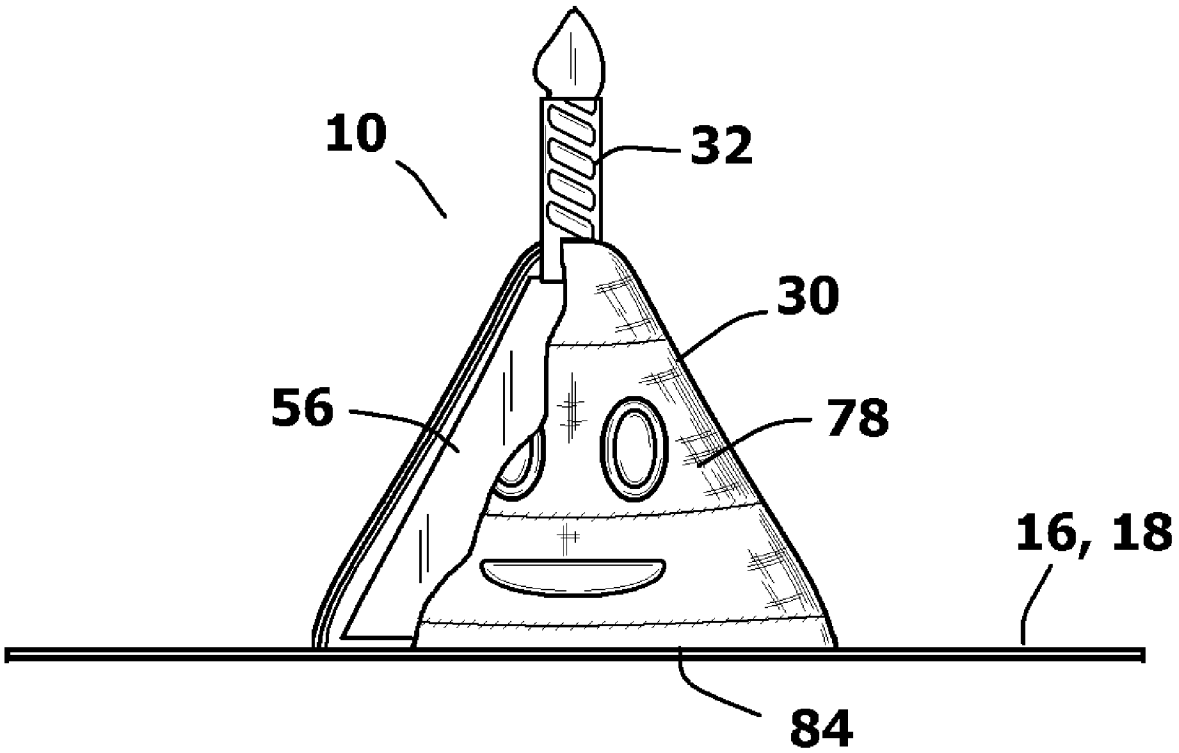
FIG. 4 shows a fragmented view of the pop-up structure in the greeting card assembly when in a mostly opened configuration.
Figure 5:
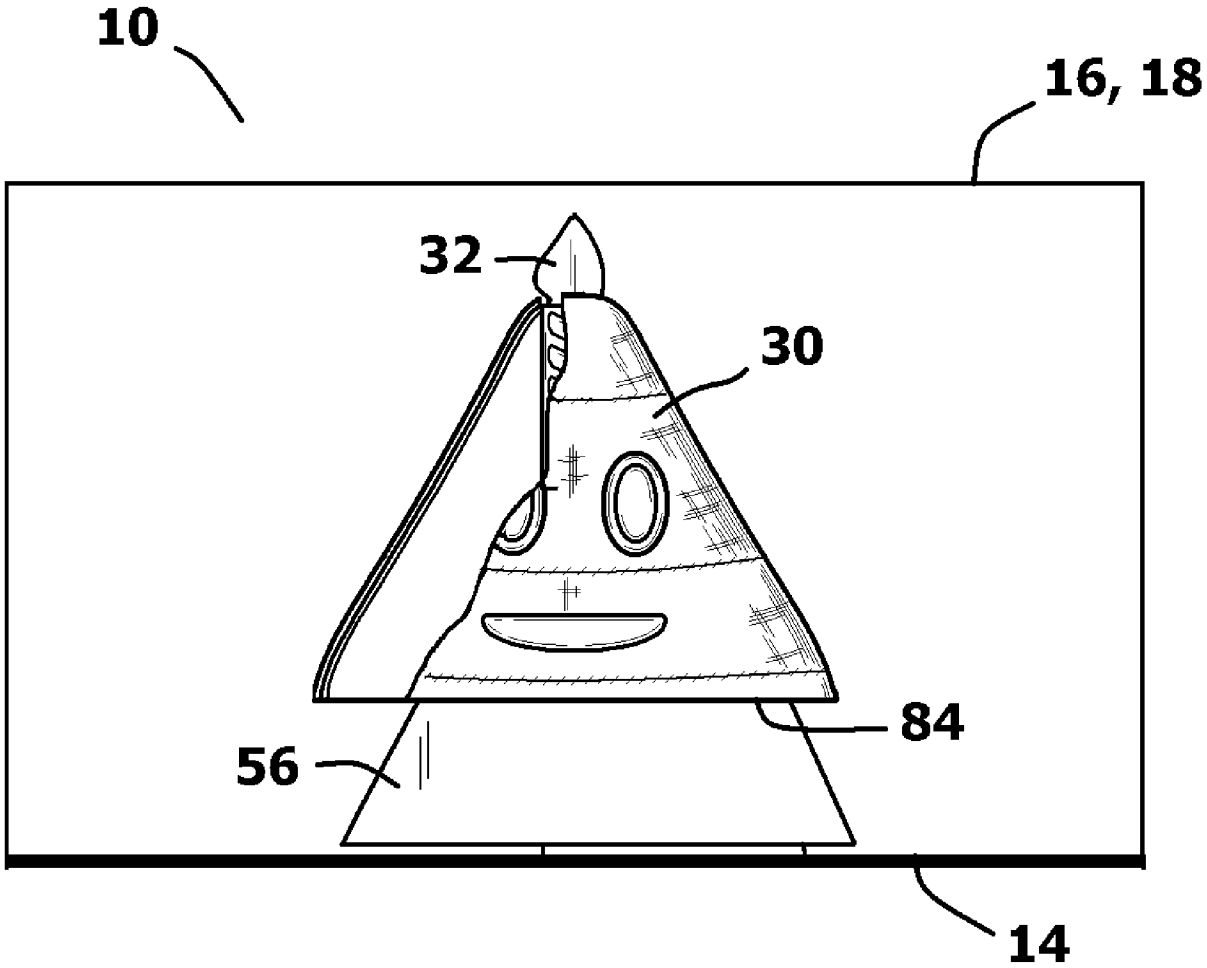
FIG. 5 shows a fragmented view of the pop-up structure in the greeting card assembly when in a mostly close configuration.

When the greeting card assembly 10 is moved into its closed configuration, the open base 84 of the plush body 30 is compressed flat into a straight line. The straight line is parallel to the central fold seam 14 between the two flaps 16, 18. The plush body 30 compresses flat against the face surface 60 and the back surface 62 of the flat center support 56, therein ensuring that the open base 84 of the plush body 30 will compress into a straight line that is parallel to the central fold seam 14. Referring to FIG. 4 and FIG. 5 in conjunction with FIG. 3, it will be understood that when the greeting card assembly 10 is in its open configuration, the first flap 16 and the second flap 18 are coplanar. Furthermore, the open base 84 of the plush body 30 rests flush atop both flaps 16, 18 with the plane of the open base 84 being parallel to the plane of the flaps 16, 18. In this open configuration, the flat center support 56 is fully enveloped by the plush body 30. As such, the flat center support 56 cannot be seen. The appendage 32 that extends above the flat center support 56 extends above the plush shell 78 and is visible.

The plush body 30 is attached to the first flap 16 at a distance from the central fold seam 14. Likewise, the plush body 30 is attached symmetrically to the second flap 18 at the same distance from the central fold seam 14. When the greeting card assembly 10 is moved into its closed configuration, the open base 84 of the plush body 30 begins to close and moves away from the central fold seam 14. The flat center support 56 is attached to the base substrate 12 near the central fold seam 14. As a result, the flat center support 56 also moves partially below the open base 84 of the plush body 30 as the flaps 16, 18 close. The retracting flat center support 56 causes the appendage 32 to sink into the plush body 30. In this manner, the plush body 30 and the appendage 32 are fully covered by the flaps 16, 18 when the greeting card assembly 10 is closed.

Referring to all figures, it will be understood that the greeting card assembly 10 can be folded closed. When closed, the greeting card assembly 10 is thin enough to fit into a traditional paper envelope. When closed, there are no parts of the pop-up construct 28 that extend beyond the edges of the two opposing flaps 16, 18 of the greeting card assembly 10. When the greeting card assembly 10 is closed, the plush body 30 within the greeting card assembly 10 is pressed flat against the flat center support 56.

When the greeting card assembly 10 is opened, the open base 84 of the plush body 30 is opened from opposing sides. This spreads the open base 84 and opens the plush body 30 into a more three-dimensional shape. Simultaneously, the flat center support 56 is advanced into the plush body 30 to support the plush body 30 and prevent the plush body 30 from collapsing. Furthermore, the appendage 32 is advanced through the center of the plush body 30, wherein the appendage 32 extends to an elevation above the plush body 30. As the plush body 30 opens and its open base 84 descends to the plane of the open flaps 16, 18, the control circuitry 68 on the circuit board 66 is activated. This causes the lights 34 to light and the audio system 36 to broadcast music or other sounds.

It will be understood that the embodiment of the present invention that is illustrated and described is merely exemplary and that a person skilled in the art can make many variations to that embodiment. For instance, the plush body can have many shapes other than the emoji shown. Likewise, the lights can be positioned in many configurations other than what is shown. All such embodiments are intended to be included within the scope of the present invention as defined by the claims.

What is claimed is:

1. A greeting card assembly comprising:

a first flap and a second flap joined at a central fold seam, wherein said first flap is rotated over said second flap to a closed configuration and is rotated away from said second flap to an open configuration;

a center support extending vertically over said central fold seam, wherein said center support has a flat face surface and a flat back surface; and a plush body having a plush exterior surface, wherein said plush body has a hollow interior accessible through an open bottom;

wherein said plush body is attached to said first flap at a first distance from said central fold seam and said plush body is attached to said second flap at a second distance from said central fold seam;

wherein said center support extends into said interior of said plush body through said open bottom and wherein said plush body is pressed against said flat face surface and said flat back surface of said center support when said first flap is moved into said closed configuration.

2. The greeting card assembly according to claim 1, wherein said plush body and said center support are not interconnected and move independently.

3. The greeting card assembly according to claim 1, wherein said plush body has a plush material supported by a paper liner, wherein said paper liner is attached to said first flap and to said second flap.

4. The greeting card assembly according to claim 3, wherein said paper liner is attached to said first flap and to said second flap at points symmetrically disposed about said central fold line.

5. The greeting card assembly according to claim 1, further including an appendage that extends from said center support.

6. The greeting card assembly according to claim 5, wherein said appendage extends through said plush body and terminates at an elevation above said plush body when said first flap is in said open configuration.

7. The greeting card assembly according to claim 1, wherein said first flap contains a circuit board interposed between a first panel and a second panel.

8. The greeting card assembly according to claim 7, wherein said circuit board controls a plurality of lights that are interposed between said first panel and said second panel.

9. The greeting card assembly according to claim 8, wherein holes are disposed in said second panel, wherein said holes align over said plurality of lights.

10. A greeting card assembly comprising:

a first flap and a second flap joined at a central fold seam, wherein said first flap and said second flap are relatively movable about said central fold seam between an open configuration and a closed configuration;

a plush body having an internal paper liner covered in a plush fabric exterior, wherein said plush body has a hollow interior accessible through an open bottom;

wherein said internal paper liner is attached to said first flap and said second flap at points equidistance from said central fold seam.

11. The greeting card assembly according to claim 10, further including a center support extending vertically over said central fold seam, wherein said center support has a flat face surface and a flat back surface.

12. The greeting card assembly according to claim 11, wherein said center support extends into said interior of said plush body through said open bottom and wherein said plush body is pressed against said flat face surface and said flat back surface of said center support when in said first flap and said second flap are in said closed configuration.

13. The greeting card assembly according to claim 12, wherein said plush body and said center support are not interconnected and move independently.

14. The greeting card assembly according to claim 10, further including an appendage that extends from said center support.

15. The greeting card assembly according to claim 14, wherein said appendage extends through said plush body and terminates at an elevation above said plush body when in said open configuration.

16. The greeting card assembly according to claim 10, wherein said first flap contains a circuit board interposed between a first panel and a second panel.

17. The greeting card assembly according to claim 16, wherein said circuit board controls a plurality of lights that are interposed between said first panel and said second panel.

18. The greeting card assembly according to claim 17, wherein holes are disposed in said second panel, wherein said holes align over said plurality of lights.

* * * * *